US009748638B2

(12) United States Patent
Wei et al.

(10) Patent No.: US 9,748,638 B2
(45) Date of Patent: Aug. 29, 2017

(54) ELECTRONIC DEVICE

(71) Applicant: Acer Incorporated, New Taipei (TW)

(72) Inventors: Wan-Chu Wei, New Taipei (TW); Yu-Chia Chang, New Taipei (TW); Hsin-Wu Chiang, New Taipei (TW); Hsieh-Chih Lin, New Taipei (TW); Pei-Chi Ma, New Taipei (TW); Pang-Chun Tsai, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 14/992,024

(22) Filed: Jan. 11, 2016

(65) Prior Publication Data

US 2017/0117613 A1 Apr. 27, 2017

(30) Foreign Application Priority Data

Oct. 21, 2015 (TW) ..... 104134518 A

(51) Int. Cl.
*H01Q 1/24* (2006.01)
*H01Q 21/30* (2006.01)

(52) U.S. Cl.
CPC ..... *H01Q 1/243* (2013.01); *H01Q 21/30* (2013.01)

(58) Field of Classification Search
CPC ..... H01Q 1/242; H01Q 1/243
See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 8,872,706 | B2 * | 10/2014 | Caballero | H01Q 1/243 343/702 |
| 2013/0169490 | A1 * | 7/2013 | Pascolini | H01Q 5/357 343/702 |
| 2014/0333495 | A1 | 11/2014 | Vazquez et al. | |
| 2015/0123871 | A1 * | 5/2015 | Chang | H01Q 1/243 343/872 |

(Continued)

FOREIGN PATENT DOCUMENTS

| | | |
|---|---|---|
| CN | 101640949 | 2/2010 |
| CN | 102204013 | 9/2011 |
| CN | 204289695 | 4/2015 |

(Continued)

*Primary Examiner* — Dameon E Levi
*Assistant Examiner* — Hasan Islam
(74) *Attorney, Agent, or Firm* — Jianq Chyun IP Office

(57) ABSTRACT

An electronic device including a ground plane, a metal frame, a plurality of radiation elements and a switching circuit is provided. A first end of a frame element in the metal frame is connected to the ground plane, and a second end of the frame element is an open end. Each of the radiation elements is spaced by a coupling distance from the frame element. The switching circuit transmits a feeding signal to one of the radiation elements. When the feeding signal is transmitted to a first radiation element among the radiation elements, the electronic device operates in a first band and a second band through the first radiation element and the frame element. When the feeding signal is transmitted to a second radiation element among the radiation elements, the electronic device operates in a third band and a fourth band through the second radiation element and the frame element.

10 Claims, 2 Drawing Sheets

(56) References Cited

U.S. PATENT DOCUMENTS

| | | | | |
|---|---|---|---|---|
| 2015/0207211 | A1* | 7/2015 | Martiskainen ..... | H01Q 21/30<br>343/702 |
| 2016/0049719 | A1* | 2/2016 | Tseng ..... | H01Q 1/243<br>343/702 |

FOREIGN PATENT DOCUMENTS

| | | |
|---|---|---|
| TW | 201445810 | 12/2014 |
| TW | 201537828 | 10/2015 |

* cited by examiner

ELECTRONIC DEVICE

CROSS-REFERENCE TO RELATED APPLICATION

This application claims the priority benefit of Taiwan application serial no. 104134518, filed on Oct. 21, 2015. The entirety of the above-mentioned patent application is hereby incorporated by reference herein and made a part of this specification.

BACKGROUND OF THE INVENTION

Field of the Invention

The invention relates to an electronic device, and particularly relates to an electronic device with a metal frame.

Description of Related Art

Along with quick development of wireless communication technology, besides electronic devices have diversified communication functions, appearance designs thereof are also an important factor for attracting consumers. For example, in recent years, electronic devices with a metallic texture are well received by the consumers. Therefore, the electronic devices are generally equipped with a metal back cover or a metal frame to highlight the uniqueness and an appearance design of the product.

However, a radiation characteristic of an antenna element is easily affected by surrounding metal objects. Therefore, when the electronic device is equipped with the metal frame according to the requirement of the appearance design, communication quality of the electronic device is generally affected. In other words, the appearance design of metallic texture brings a sense of fashion to the electronic device, but also brings a larger challenge to the design of the antennas in the electronic device.

SUMMARY OF THE INVENTION

The invention is directed to an electronic device, which is adapted to operate in a different band by using a frame element in a metal frame, so as to reduce the impact of the metal frame on communication quality of the electronic device.

The invention provides an electronic device including a ground plane, a metal frame, a plurality of radiation elements and a switching circuit. The metal frame has a plurality of gaps to form a frame element. Moreover, a first end of the frame element is electrically connected to the ground plane, and a second end of the frame element is an open end. Each of the radiation elements is spaced by a coupling distance from the frame element. The switching circuit transmits a feeding signal to one of the radiation elements. When the feeding signal is transmitted to a first radiation element among the radiation elements, the electronic device operates in a first band through the first radiation element, and operates in a second band through the frame element. When the feeding signal is transmitted to a second radiation element among the radiation elements, the electronic device operates in a third band through the second radiation element and operates in a fourth band through the frame element.

In an embodiment of the invention, the electronic device further includes an appearance member. The appearance member and the metal frame form an accommodating space. The ground plane, the radiation elements and the switching circuit are disposed in the accommodating space. An orthogonal projection of the radiation elements on the appearance member is not overlapped with an orthogonal projection of the ground plane on the appearance member.

According to the above description, the radiation elements in the electronic device are respectively spaced by a coupling distance from the frame element, and the feeding signal can be coupled to the frame element from one of the radiation elements through the coupling distance. In this way, the electronic device may operate in a band through one of the radiation elements, and may operate in another band through the frame element, so as to reduce the impact of the metal frame on the communication quality of the electronic device. Besides, the radiation elements and the frame element may form resonant paths separated from each other, so as to further improve the communication quality of the electronic device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
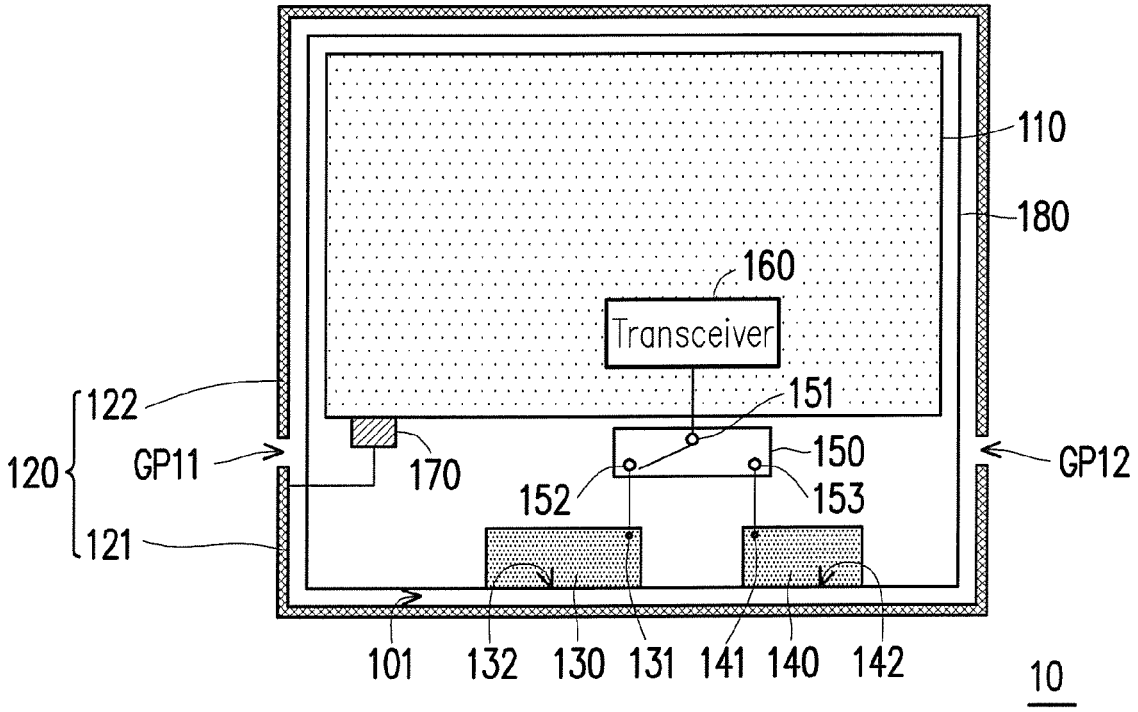
FIG. 1 is a schematic diagram of an electronic device according to an embodiment of the invention.

FIG. 1 is a schematic diagram of an electronic device according to an embodiment of the invention. As shown in FIG. 1, the electronic device 10 includes a ground plane 110, a metal frame 120, a radiation element 130, a radiation element 140 and a switching circuit 150. The metal frame 120 has a plurality of gaps to form a plurality of frame elements disconnected from each other. For example, the metal frame 120 is separated into a frame element 121 and a frame element 122 through a gap GP11 and a gap GP12. Moreover, a shape of the frame element 121 is approximately a U-shape. A first end of the frame element 121 is electrically connected to the ground plane 110, and a second end of the frame element 121 is an open end.

The radiation element 130 is spaced by a coupling distance 101 from the frame element 121, and the radiation element 140 is also spaced by the coupling distance 101 from the frame element 121. For example, the radiation element 130 has a feeding point 131 and an edge 132, and the edge 132 of the radiation element 130 is spaced by the coupling distance 101 from the frame element 121. Similarly, the radiation element 140 has a feeding point 141 and an edge 142, and the edge 142 of the radiation element 140 is spaced by the coupling distance 101 from the frame element 121. The coupling distance 101 is smaller than 2 mm.

The switching circuit 150 is electrically connected to the radiation element 130 and the radiation element 140, and transmits a feeding signal to the radiation element 130 or the radiation element 140. For example, in an embodiment, the electronic device 10 further includes a transceiver 160 used for generating the feeding signal. Moreover, the switching circuit has a first connecting end 151, a second connecting end 152 and a second connecting end 153. The first connecting end 151 of the switching circuit 150 is electrically connected to the transceiver 160. The second connecting end 152 of the switching circuit 150 is electrically connected to the feeding point 131 of the radiation element 130. The second connecting end 153 of the switching circuit 150 is electrically connected to the feeding point 141 of the radiation element 140. The switching circuit 150 may electrically connect the first connecting end 151 to the second connecting end 152 or 153 according to a control signal, so as to transmit the feeding signal from the transceiver 160 to the radiation element 130 or the radiation element 140.

In view of the operation, the electronic device 10 may receive or transmit electromagnetic waves through the radiation element 130, the radiation element 140 and the frame element 121. For example, FIG. 2 is a diagram of a return loss curve according to an embodiment of the invention, and the operation of the electronic device 10 is further described below with reference to FIG. 1 and FIG. 2.

Figure 2:
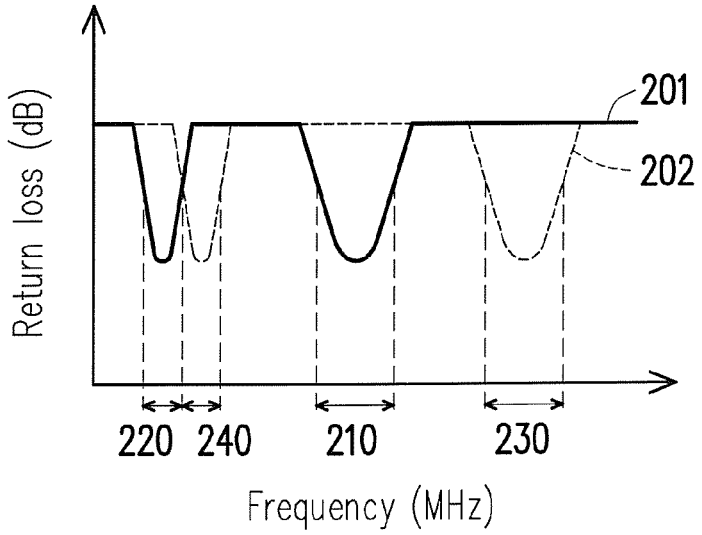
FIG. 2 is a diagram of a return loss curve according to an embodiment of the invention.

To be specific, when the first connecting end 151 and the second connecting end 152 of the switching circuit 150 are electrically connected, i.e. when the feeding signal is transmitted to the radiation element 130 through the switching circuit 150, the radiation element 130 and the frame element 121 may generate a return loss curve 201 as shown in FIG. 2. In detail, when the feeding signal is transmitted to the radiation element 130, the radiation element 130 may generate a first resonant mode, and the electronic device 10 may operate in a first band 210 shown in FIG. 2 through the radiation element 130. Moreover, through the coupling distance 101, the feeding signal can be further coupled to the frame element 121 from the radiation element 130. In this way, under the excitation of the feeding signal, the frame element 121 may generate a second resonant mode, and the electronic device 10 may operate in a second band 220 shown in FIG. 2 through the frame element 121.

On the other hand, when the first connecting end 151 and the second connecting end 153 of the switching circuit 150 are electrically connected, i.e. when the feeding signal is transmitted to the radiation element 140 through the switching circuit 150, the radiation element 140 and the frame element 121 may generate a return loss curve 202 as shown in FIG. 2. In detail, when the feeding signal is transmitted to the radiation element 140, the radiation element 140 may generate a third resonant mode, and the electronic device 10 may operate in a third band 230 shown in FIG. 2 through the radiation element 140. Moreover, through the coupling distance 101, the feeding signal can be further coupled to the frame element 121 from the radiation element 140. In this way, under the excitation of the feeding signal, the frame element 121 may generate a fourth resonant mode, and the electronic device 10 may operate in a fourth band 240 shown in FIG. 2 through the frame element 121.

It should be noted that the resonant mode generated by the frame element 121 is determined by a length of the frame element 121 and a coupling length between the frame element 121 and the radiation element. Therefore, when the frame element 121 has different coupling lengths in response to different radiation elements, the frame element 121 may generate different resonant modes in response to the different radiation elements. For example, the coupling length between the frame element 121 and the radiation element 130 is equal to a length of the edge 132 of the radiation element 130, and the coupling length between the frame element 121 and the radiation element 140 is equal to a length of the edge 142 of the radiation element 140. Moreover, the length of the edge 132 of the radiation element 130 is greater than the length of the edge 142 of the radiation element 140. Therefore, a frequency of the second band 220 in the second resonant mode generated by the frame element 121 in response to the radiation element 130 is lower than a frequency of the fourth band 240 in the fourth resonant mode generated by the frame element 121 in response to the radiation element 140.

Moreover, the second band 220 and the fourth band 240 are adjacent to each other to form a low frequency band with a frequency range of 700 MHz-960 MHz. The electronic device 10 may further operate in different high frequency bands through the radiation element 130 and the radiation element 140. For example, a frequency range of the first band 210 covered by the radiation element 130 is, for example, 1710 MHz-2170 MHz, and a frequency range of the third band 230 covered by the radiation element 140 is, for example, 2500 MHz-2690 MHz. In other words, in an embodiment, the frequency of the fourth band 240 is higher than the frequency of the second band 220, the frequency of the first band 210 is higher than the frequency of the fourth band 240, and the frequency of the third band 230 is higher than the frequency of the first band 210.

It should be noted that the electronic device 10 may receive or transmit the electromagnetic wave through a part of the metal frame 120 (for example, the frame element 121). In other words, the electronic device 10 may use a part of the metal frame 120 to serve as an antenna element, so as to reduce the impact of the metal frame 120 on the communication quality of the electronic device 10. Moreover, the electronic device 10 operates in the low frequency band through the frame element 121, and operates in the high frequency band through the radiation elements 130 and 140. Since the frame element 121 is not connected to the radiation elements 130 and 140, i.e. a resonant path of the low frequency band of the antenna element is separated from a resonant path of the high frequency band, the communication quality of the electronic device 10 can be further improved.

Further, the electronic device 10 further includes an inductive element 170 and an appearance member 180. The first end of the frame element 121 is electrically connected to the ground plane 110 through the inductive element 170, so as to extend the resonant path of the frame element 121 in the resonant mode. In other words, the electronic device 10 may adjust a center frequency of the second band and the fourth band covered by the frame element 121 through the inductive element 170. Comparatively, those skilled in the art may selectively remove the inductive element 170 according to a design requirement.

The appearance member 180 and the metal frame 120 form an accommodating space. The ground plane 110, the radiation element 130, the radiation element 140, the switching circuit 150, the transceiver 160 and the inductive element 170 are disposed in the accommodating space. An orthogonal projection of the radiation elements 130 and 140 on the appearance member 180 is not overlapped with an orthogonal projection of the ground plane 110 on the appearance member 180. In an embodiment, the appearance member 180 is, for example, a plastic back cover, and the radiation element 130, the radiation element 140 and the ground plane 110 are attached to the plastic back cover. In another embodiment, the appearance member 180 is, for example, a metal back cover electrically connected to the ground plane 110.

It should be noted that the radiation element 130 and the radiation element 140 in FIG. 1 can be respectively composed of a metal sheet to respectively form a monopole antenna. Although the embodiment of FIG. 1 provides an implementation pattern of the radiation element 130 and the radiation element 140, the invention is not limited thereto. For example, those skilled in the art may use a planar inverted F antenna (PIFA), a dipole antenna or a loop antenna to respectively implement the radiation element 130 and the radiation element 140 according to an actual design requirement.

Figure 3:
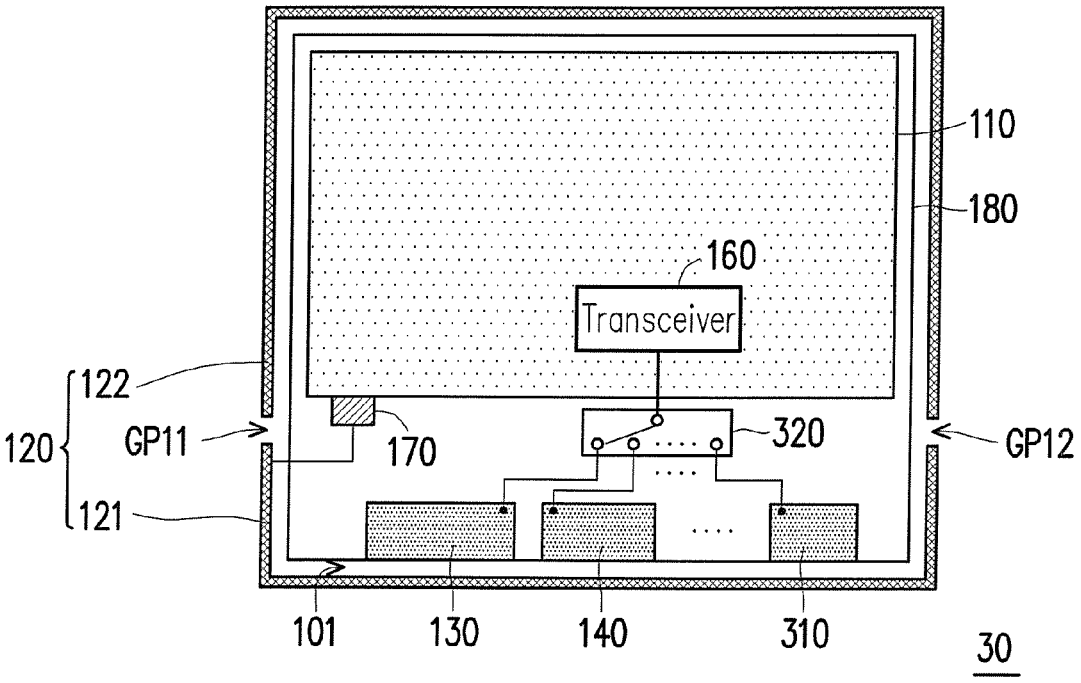
FIG. 3 is a schematic diagram of an electronic device according to another embodiment of the invention.

Besides, in the embodiment of FIG. 1, the electronic device 10 uses two radiation elements 130 and 140 to respectively excite the frame element 121 by coupling. In another embodiment, the electronic device 10 may use more than two radiation elements to respectively excite the frame element 121 by coupling. For example, FIG. 3 is a schematic diagram of an electronic device according to another embodiment of the invention. Compared to the embodiment of FIG. 1, the electronic device 30 of FIG. 3 includes more than two radiation elements, for example, the radiation element 130, the radiation element 140, a radiation element 310, etc.

Since the electronic device 10 of FIG. 1 includes two radiation elements 130 and 140, the switching circuit 150 in the electronic device 10 is, for example, a one-to-two switch. Comparatively, since the electronic device 30 of FIG. 3 includes a plurality of radiation elements, the switching circuit 320 in the electronic device 30 is, for example, a one-to-many switch. For example, the switching circuit 320 includes a first connecting end and a plurality of second connecting ends. The first connecting end of the switching circuit 320 is electrically connected to the transceiver 160. The plurality of second connecting ends of the switching circuit 320 are one-to-one corresponding to the plurality of radiation elements in the electronic device 30, and each of the second connecting ends is electrically connected to the corresponding radiation element. The switching circuit 320 may electrically connect the first connecting end to one of the plurality of second connecting ends according to a control signal.

Similar to the embodiment of FIG. 1, the switching circuit 320 may transmit the feeding signal coming from the transceiver 160 to one of the radiation elements. Moreover, when the switching circuit 320 transmits the feeding signal to the radiation element 130, the electronic device 30 may operate in the first band and the second band through the radiation element 130 and the frame element 121. When the switching circuit 320 transmits the feeding signal to the radiation element 140, the electronic device 30 may operate in the third band and the fourth band through the radiation element 140 and the frame element 121.

Similarly, when the switching circuit 320 transmits the feeding signal to the radiation element 310, the radiation element 310 may generate a resonant mode, and the electronic device 30 may operate in a fifth band through the radiation element 310. Moreover, through the coupling distance 101, the feeding signal can be further coupled to the frame element 121 from the radiation element 310. In this way, the frame element 121 may generate another resonant mode, and the electronic device 30 may operate in a sixth band through the frame element 121. The fifth band is, for example, another high frequency band different to the first band and the third band, and the sixth band is, for example, adjacent to the fourth band, so as to further increase a bandwidth of the low frequency band of the electronic device 30. Detailed operations of various components of the embodiment of FIG. 3 have been introduced in the aforementioned embodiment, and details thereof are not repeated.

In summary, the electronic device of the invention may select one of the radiation elements through the switching circuit, and may operate in a band through the selected radiation element. Moreover, the feeding signal can be coupled to the frame element of the metal frame from the selected radiation element through the coupling distance, such that the electronic device may operate in another band through the frame element. In other words, the electronic device may use a part of the metal frame to receive or transmit the electromagnetic wave, so as to reduce the impact of the metal frame on the communication quality of the electronic device. Moreover, the radiation elements and the frame element may form resonant paths separated from each other, so as to further improve the communication quality of the electronic device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic device, comprising:

a ground plane;

a metal frame, having a plurality of gaps to form a frame element, wherein a first end of the frame element is electrically connected to the ground plane, and a second end of the frame element is an open end;

a plurality of radiation elements, enclosed by the frame element, and each of the radiation elements being spaced by a coupling distance from the frame element; and a switching circuit, selecting one of the radiation elements to transmit a feeding signal, wherein when the feeding signal is transmitted to a first radiation element among the radiation elements, the electronic device operates in a first band through the first radiation element, and operates in a second band through the frame element, and when the feeding signal is transmitted to a second radiation element among the radiation elements, the electronic device operates in a third band through the second radiation element and operates in a fourth band through the frame element.

2. The electronic device as claimed in claim 1, further comprising:

an appearance member, forming an accommodating space together with the metal frame, wherein the ground plane, the radiation elements and the switching circuit are disposed in the accommodating space, and an orthogonal projection of the radiation elements on the appearance member is not overlapped with an orthogonal projection of the ground plane on the appearance member.

3. The electronic device as claimed in claim 2, wherein the appearance member is a plastic back cover, and the radiation elements and the ground plane are attached to the plastic back cover.

4. The electronic device as claimed in claim 2, wherein the appearance member is a metal back cover, and the metal back cover is electrically connected to the ground plane.

5. The electronic device as claimed in claim 2, further comprising:

a transceiver, disposed in the accommodating space, and generating the feeding signal, wherein the switching circuit has a first connecting end and a plurality of second connecting ends, the first connecting end is electrically connected to the transceiver, and the second connecting ends are electrically connected to the radiation elements, and the switching circuit connects the first connecting end to one of the second connecting ends according to a control signal.

6. The electronic device as claimed in claim 2, further comprising:

an inductive element, disposed in the accommodating space, wherein the first end of the frame element is electrically connected to the ground plane through the inductive element.

7. The electronic device as claimed in claim 1, wherein a shape of the frame element is a U-shape.

8. The electronic device as claimed in claim 1, wherein a first edge of the first radiation element is spaced by the coupling distance from the frame element, a second edge of the second radiation element is spaced by the coupling distance from the frame element, and a length of the first edge is greater than a length of the second edge, such that a frequency of the second band is lower than a frequency of the fourth band.

9. The electronic device as claimed in claim 8, wherein a frequency of the third band is higher than a frequency of the first band, and the frequency of the first bend is higher than the frequency of the fourth band.

10. The electronic device as claimed in claim 1, wherein the radiation elements are respectively a monopole antenna, a planar inverted F antenna, a dipole antenna or a loop antenna.

* * * * *